United States Patent [19]

Weisenburger

[11] 4,160,573

[45] Jul. 10, 1979

[54] FLAT CABLE CONNECTOR

[75] Inventor: Lawrence P. Weisenburger, Kernersville, N.C.

[73] Assignee: AMP Incorporated, Harrisburg, Pa.

[21] Appl. No.: 853,608

[22] Filed: Nov. 21, 1977

[51] Int. Cl.[2] ..... H01R 13/38

[52] U.S. Cl. ..... 339/99 R; 339/176 MF

[58] Field of Search ..... 339/97 R, 97 P, 98, 339/99, 95 R, 176 MF

[56] References Cited

U.S. PATENT DOCUMENTS

| | | | |
|---|---|---|---|
| 3,162,501 | 12/1964 | Wahl | 339/98 |
| 3,611,264 | 10/1971 | Ellis, Jr. | 339/99 R |
| 3,760,331 | 9/1973 | Gurley | 339/97 P |
| 3,772,635 | 11/1973 | Frey et al. | 339/98 |

*Primary Examiner*—Joseph H. McGlynn
*Attorney, Agent, or Firm*—Gerald K. Kita

[57] ABSTRACT

This disclosure relates to a flat cable connector having miniature electrical contacts provided with closely spaced thin plates defining therebetween lengthy passageways for receiving closely spaced conductors of the flat cable. The edge margins of the plates are strengthened by coining, which also diagonally projects the edge margins inwardly toward the passageways to provide wire gripping jaws. The disclosure relates also to a method for assembling the cable to the connector whereby the conductors are successfully aligned and relocated, if necessary, in proper registration with the electrical contacts prior to insertion of the conductors in the contacts.

6 Claims, 11 Drawing Figures

FLAT CABLE CONNECTOR

BACKGROUND OF THE INVENTION

The present invention relates to a connector for flat cable, and more particularly, to a connector having multiple electrical contacts which are assembled to conductors of a flat cable. The invention further relates to a technique for assembling a connector to a flat cable by successively aligning and relocating wires of the cable with corresponding contacts.

Flat cable consists of a plurality of wires in a parallel array embedded in a jacket of insulation. The wires are also coplanar, giving the cable the appearance of being flat. The insulation jacket typically is extruded or built up with laminates, encasing each wire in insulation which separates the wires laterally from one another. Due to manufacturing tolerances the conductors drift from desired spacing and parallel alignment. This creates a significant problem in registration of the conductors with corresponding contacts of the connector. U.S. Pat. Nos. 3,820,055 and 3,964,816 disclose the practical method of assembling a connector onto flat cable. The connector includes slotted plate type contacts laterally spaced apart. The cable conductors are placed in registration over the contacts. Then the wires are pressed into slots of corresponding contacts. All of the wires are inserted simultaneously in the contact slots without having to handle each wire separately. This assembly method assumes that the wires are disposed correctly in the cable and thereby in alignment with the contacts for proper insertion therein. However, if a wire is misaligned in the cable jacket, as is often the occurrance because of manufacturing tolerances, it may fail to make effective electrical engagement with a contact.

Flat cable is becoming miniaturized. For example the centerline spacing of wires in a flat cable has narrowed from 0.1 inches to 0.025 inches, largely as a result of an electrical requirement for controlled impedance cable, typically in the range of 90 to 120 ohms, made possible by the availability of superior dielectrics such as polytetrafluroethylene. The wire thickness ranges from 0.006 to 0.010 inches, which means the space laterally between wires varies from 0.015 to 0.019 inches, requiring miniaturization of the contacts. Miniaturization of the contacts creates difficulty in contact fabrication and aggravates the problem of registration of the wires with the contacts prior to insertion therein. For example, each contact of U.S. Pat. No. 3,820,055 is formed from a metal plate provided with a wire receiving slot. Sufficient metal is required on both sides of the slot to resist deformation when the wire is inserted. Therefore the width of the plate remains relatively large, which prevents use of the contact with narrowly spaced apart conductors. In U.S. Pat. No. 3,964,816 the contacts of plate form disclosed therein are of cylindrical or barrel configuration. The barrel configuration is therefore difficult to miniaturize because of substantial deformation stresses required for bending in a circle. This contact has the advantage of two slots which provide two pairs of gripping jaws for connection to each wire.

U.S. Pat. No. 3,760,331, discloses a contact which has opposed U-shaped plates receiving a wire therebetween. Each end of the plates is bent in a smooth curve to form the U-shape. Each end is also provided with serrated edges which penetrate insulation on an individual wire. The contacts advantageously provide two pairs of wire gripping jaws for each inserted wire. However the metal stock thickness and the smoothly curved U-shape of the opposed plates provide a bulkiness unsuitable for use with closely spaced wires such as in a flat cable.

BRIEF DESCRIPTION

The present invention relates to a flat cable connector having contacts suitable for use with cable wires on 0.025 in centerlines. The contacts are formed into a pair of closely spaced thin plates connected by bight portions. The plates face each other and define therebetween a wire receiving passageway. A cable wire is forcefully inserted laterally between the plates. Edge margins of the plates are coined inwardly toward the passageway to form diagonally converging and sharp edged wire gripping jaws. Said coining work hardens and thereby strengthens the metal adjacent the jaws to resist deformation of the thin sheet metal and to assure gripping pressure on the inserted wire.

Two pairs of jaws are provided to grip the wire in two locations along the length thereof. The jaws of each pair are directly opposed for gripping opposite sides of the inserted wire. To minimize the width of each contact, the plates on either side of an inserted wire are made as thin as possible. The width of the contact allows its use with closely adjacent cable wires of small gauge.

The connector of the present invention further includes wire aligning fingers which position substantial lengths of closely spaced cable wires in proper registration with the relatively lengthy plates which are also narrowly spaced apart. A cover for the base is latchably secured to the fingers, enclosing the jaws and inserted parts of the wires. The cover closely surround the contacts and the wires in the assembly. The cover also has wire aligning projections.

A technique is disclosed whereby the wires are individually aligned and relocated, if necessary, in proper registration with the narrow width contacts. A central section of the cable jacket is removed to expose lengths of the wires which bridge between remaining sections of the jacket. The cable is then partially rolled, or smoothly bent, in a curve transversely of its length. The wires remain straight and coplanar within a curved plane. The curved cable then is located over the connector and progressively unrolled to its flat configuration. In so doing the wires become successively aligned with the contacts mounted in the connector.

Any wire which is misaligned in the cable jacket is individually relocated upon insertion between alignment fingers of the connector. Each wire, therefore, is aligned separately and successively in the connector without having to cull each wire from the cable. The present invention, therefore, is capable of relocating individual wires of the cable while advantageously treating the cable as an undivided or unitary entirety and not as individual wires.

OBJECTS

An object of the present invention is to provide a connector for flat cable which has alignment fingers for aligning and relocating, if necessary, individual wires of a flat cable in proper registration with narrow and closely spaced contacts of the connector.

Another object of the present invention is to provide a method for assembling a connector to conductors of a flat cable by progressively unrolling the cable from a curved configuration to a flat configuration, thereby individually aligning and relocating, if necessary, the conductors of said cable in registration with narrow electrical contacts of the connector.

Another object of the present invention is to provide a connector and method of assembly thereof to a flat cable having multiple conductors successively aligned and relocated if necessary in proper registration with narrow and closely spaced contacts mounted on the connector.

Another object of the present invention is to provide a narrow electrical contact having thin sheet metal plates facing each other and provided with coined edges forming work hardened areas adjacent diagonally projecting wire gripping jaws for engaging a wire inserted lengthwise between the plates.

Another object of the present invention is to provide a flat cable connector with alignment fingers which align and relocate the conductors of a flat cable in registration with electrical contacts, each of minimized width occasioned by a pair of thin plates facing each other and extending lengthwise of a cable conductor inserted therebetween, the ends of the plates being strengthened by being coined, and the ends of the plates being coined to project diagonally inwardly to provide two pairs of wire gripping jaws for gripping the inserted wire at two locations along the length thereof.

Other objects and many attendant advantages of the present invention will become apparent from the following detailed description taken in conjunction with the accompanying drawings.

DETAILED DESCRIPTION

Figure 1:
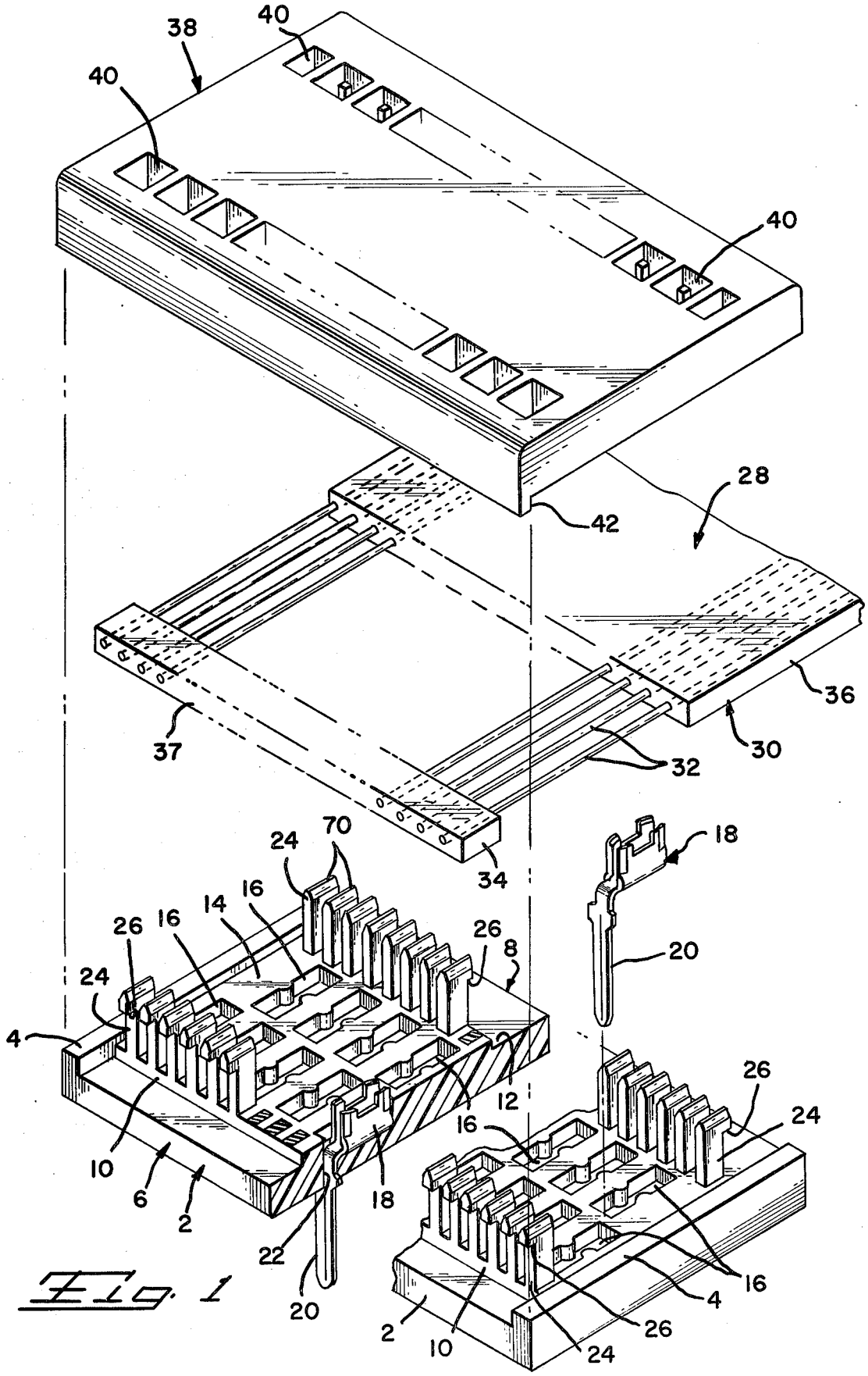
FIG. 1 is an enlarged fragmentary perspective with component parts in exploded configuration to illustrate the details of a flat cable connector preferred embodiment.
Figure 2:
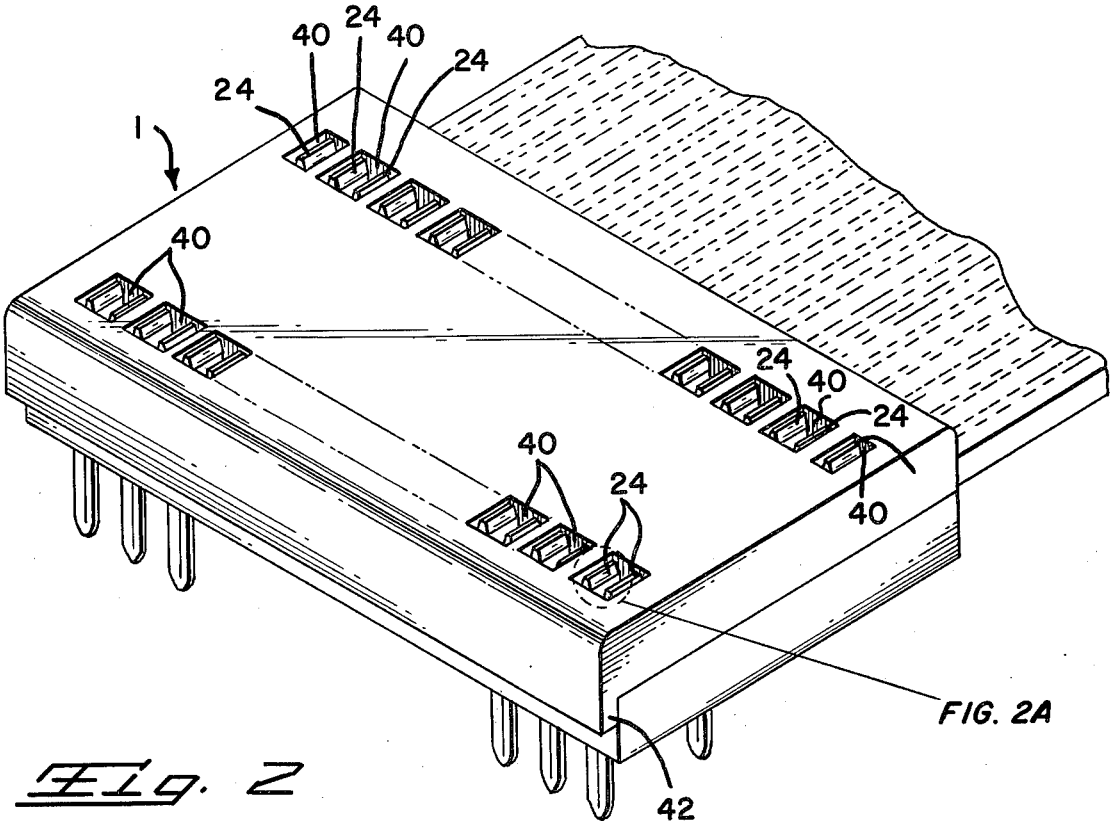
FIG. 2 is an enlarged fragmentary perspective illustrating the component parts of FIG. 1 fully assembled.

With more particular reference to FIGS. 1 and 2 of the drawings there is shown generally at 1 an electrical connector for flat cable according to the present invention. The connector includes a planar, generally horizontal base 2 molded from a rigid dielectric and provided with a pair of integral, vertical and longitudinal sidewalls 4. Both the forward end 6 and the rearward end 8 of the base 2 have vertically recessed channels 10 and 12, respectively, extending from one sidewall 4 to the other. Between the recessed portions 10 and 12, the floor 14 of the base 2 is provided with first and second rows of narrow rectangular recesses 16 in staggered alignment longitudinally. Relatively narrow electrical contacts are illustrated generally at 18. The contacts 18 are received in respective recesses 16. The contacts include elongated vertically depending electrical tab terminal portion 20 which project through corresponding openings 22 in the base 2 and externally outward therefrom in depending relationship from the bottom wall 14. Thereby the tab portions are suitable for pluggable electrical connection to electrical circuitry (not shown). The base 2 further includes integrally molded, vertically projecting alignment fingers or vane members 24 arranged in parallel spaced rows alongside a corresponding row of contacts. Each alignment finger is provided with an inverted L configuration providing an inverted or undercut shoulder 26. A molder dielectric cover portion of the connector is shown generally at 28 and includes rows of vertically extending recesses 30 therein. As shown more particularly in FIG. 2A, each recess 30 receives therein one or more, as the case may be, of the latching fingers 18 therein. Internally of the recesses 30 are provided integral molded projections 32 of inverted wedge shape terminating in shoulders 34 latchably received under a corresponding inverted shoulder 26 when the cover is assembled to the base 2.

Figure 3:
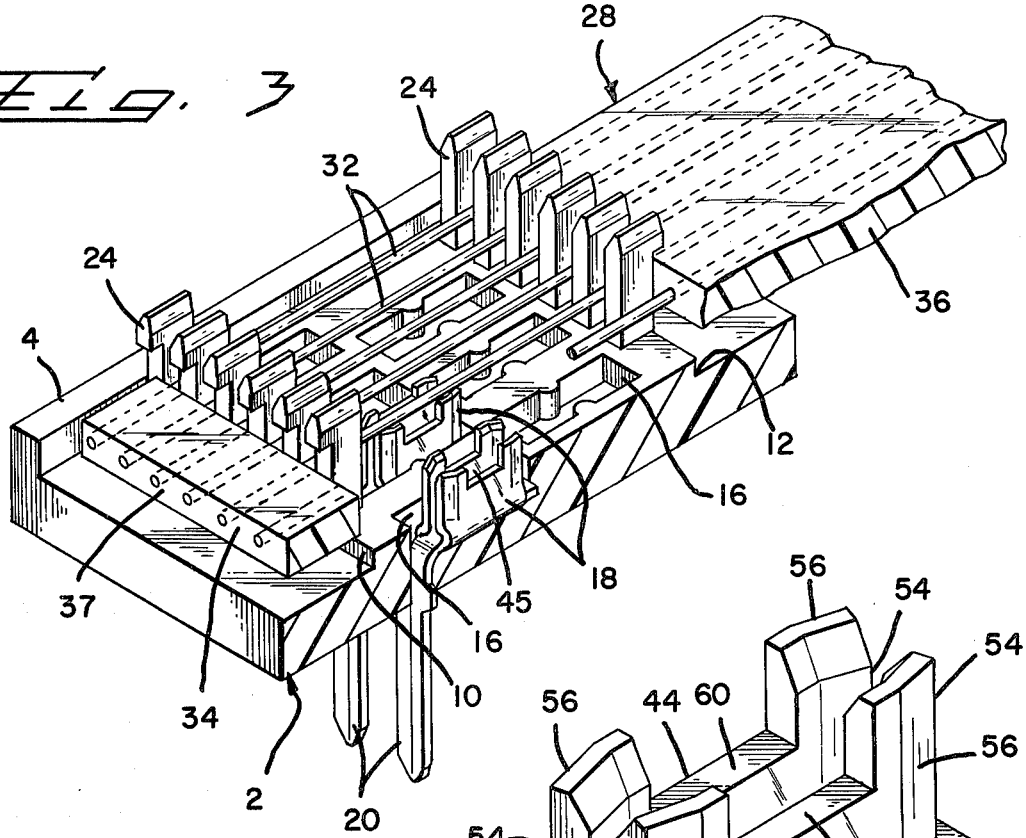
FIG. 3 is an enlarged fragmentary perspective partially in section of a base portion of the connector shown in FIG. 1 illustrating alignment and relocation, if necessary, of the conductors of a flat flexible cable interleaved with wire alignment fingers provided on the base.

The alignment fingers 26 are utilized to align the coplanar conductors or wires of a flat cable. In this respect reference is made to FIGS. 1 and 3 illustrating a flat cable generally at 28 having an outer solid, but flexible, dielectric jacket 30 and round wire conductors 32 embedded therein in a parallel coplanar array. The conductors are shown exposed and bridging between separated jacket sections 34 and 36. Jacket section 34 covers the ends of the exposed conductors 32 and is relatively short in the direction lengthwise of the conductors. It can be said that a medial portion of the cable jacket 30 is removed to expose lengths of the conductors 32 which bridge between two remainder jacket sections 34 and 36. In practice such a cable configuration is accomplished by a jacket stripping machine model 47A manufactured by Carpenter Manufacturing Company, Manlius, New York. The machine incorporates upper and lower knives which vertically slice into opposite planar surfaces of the cable jacket 30. Then the knives are displaced by the machine longitudinally with respect to a clamp, which holds the bulk of the cable stationary, breaking away the jacket section 34 from the section 36 and sliding the jacket section 34 longitudinally of the conductors 32. Subsequently the jacket section 34 and the conductors therein are trimmed to the short length configuration shown in FIGS. 1 and 3.

As shown in FIG. 3 the cable is assembled over the base 2 by interleaving the exposed conductors 32 with the alignment fingers 24. More particularly, the exposed conductors are inserted into spaces or channels between adjacent fingers 24 of each row, the fingers thereby separating the conductors laterally from one another. The fingers of one row cooperate with the fingers of the other row also to align a substantial lengthy portion of each conductor vertically over the narrow width and substantial relative length of a single corresponding electrical contact 18. As explained in detail hereinafter, once the conductors 32 are aligned with corresponding contacts 18 the conductors are forcibly inserted into electrical engagement with the contacts.

Figure 2A:
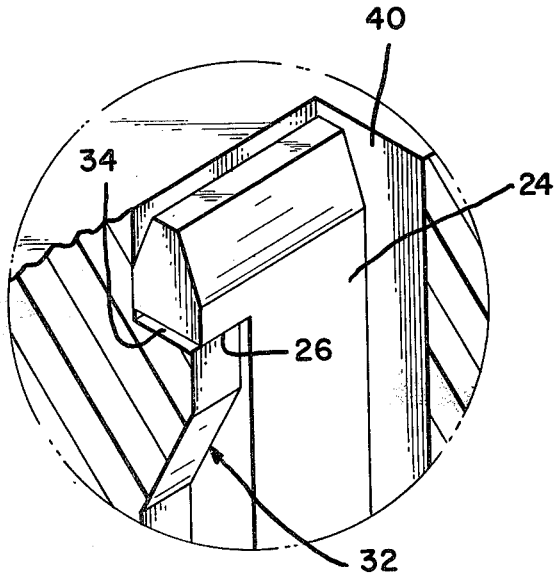
FIG. 2A is an enlarged fragmentary cut-away view of a portion of FIG. 2 encircled in phantom outline.

As shown in FIGS. 1 and 2 a molded dielectric cover portion 38 is illustrated with rows of vertical recesses 40 therein. The cover is assembled over the cable 28 and the base 2 with the alignment fingers 24 one or more being received in the recesses 40. The cover engaged the exposed conductors urging them vertically downward between the alignment fingers and into electrical contact with corresponding conductors. As shown in FIG. 2A, the cover is molded with integral projections 32 within the recesses 30. The projections 32 are provided with horizontal shoulders 34 which latchably impinge under the inverted shoulders 26 of the fingers 18 received in the recesses 30 to latchably secure the cover and base together, sandwiching the cable sections 34 and 36 therebetween. In the assembly the base and cover as shown in FIG. 2, the cable sections 34 and 36 are contained within the base recesses 10 and 12, respectively, and between the sidewalls 4. The cover includes a depending lip 22 which covers the trimmed edge 37 of the cable section 34 when the cover is assembled over the cable to the base 2.

Figure 6:
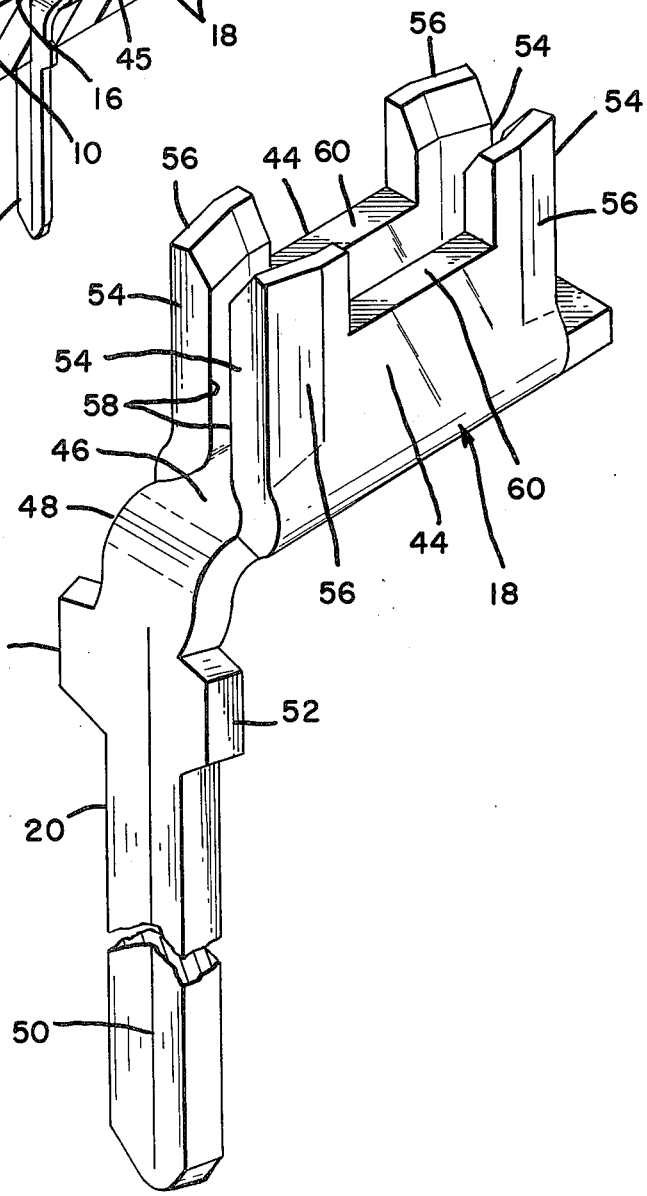
FIG. 6 is an enlarged perspective of a preferred embodiment of an electrical contact of the flat cable connector according to the present invention.
Figure 7:
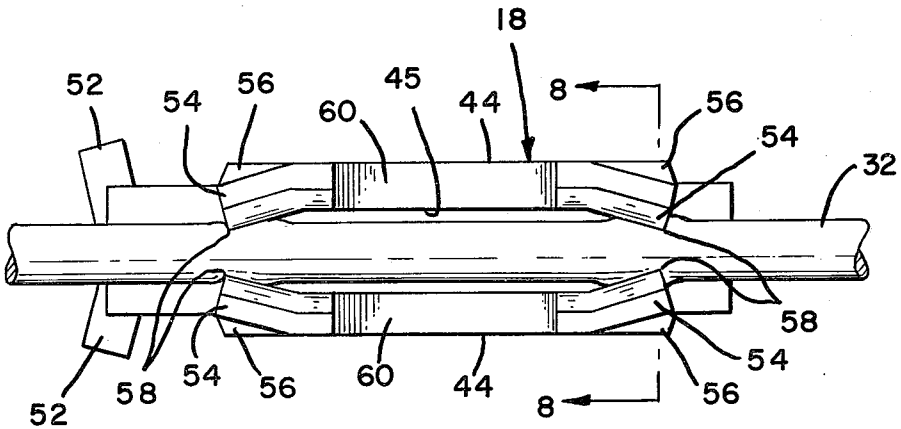
FIG. 7 is an enlarged plan view of the contact illustrated in FIG. 6 together with an inserted wire of a flat cable.

The details of each contact 18 are described with reference to FIGS. 6, 7, and 8. As shown in FIG. 6 each contact 18 is of one piece construction and is stamped and formed from 0.006 inches thick, copper-nickel-tin alloy having the designation number 6 hard CDA 725. Such an alloy is available from Olin Brass Company, located in East Alton, Illinois. The contact material also may include phos-bronze, berrylium copper or stainless steel. Each contact 18 is formed with a pair of plates 44 connected by a curved integral bight 46. As shown in FIG. 7 the plates 44 are free standing with their broad surfaces facing each other. The plates 44 of each contact are spaced apart a distance slightly greater than the diameter of a flat cable wire or conductor 32. The overall width of the contact is 0.022 inches and the length is 0.060 inches. A wire of 0.006 to 0.010 inches diameter is to be inserted between the plates.

The forces required to deform copper wire of 0.006 inches is about 35,000 pounds per square inch (PSI). The contact according to the present invention produces 2–3 pounds at each contact jaw. The wire areas deformed exceed the cross section area of the wire. For 30 gauge wire, the ratio of deformed area to cross section area is about 2:1. For 34 gauge wire, the ratio is about 2.4:1. This is produced by a contact formed from 0.006 thick stock, having a length overall of 0.060 inches, a width of 0.022 inches and a height of 0.045 inches. The clearance between a contact and an adjacent cable wire is about 0.014 inches minus one-half the diameter of the wire, when the wires are on 0.025 inches centerlines.

Figure 8:
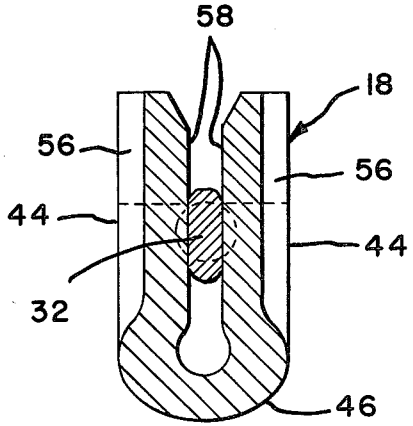
FIG. 8 is a section taken along line 8—8 of FIG. 7.

As shown in FIG. 8 the bight portion 46 is smoothly curved. This is necessitated because the small dimensions of the contact 18 make it relatively stiff to bend and form. Smoothly curved, rather than sharply bent, transitions are preferred. As shown in FIG. 6 each bight portion 46 is integral with an elongated terminal 10 or lead 20 which is smoothly bent in a curve at 48 to project at 90° with respect to the bight portion 46. Each tab 20 is sharply indented with a longitudinal central crease 50 which imparts a V-shape cross section to the lead 20 stiffening the same and allowing interference press fit thereof into a corresponding opening 22 of the base 2. Each tab 20 is further provided with an enlarged hilt portion 52 which is firmly seated within a corresponding opening 22 of the base 2 locking the contact lead 20 to the base.

When contact 18 is mounted in the base 2 the bight portion 46 is disposed horizontally, with the plates 44 vertically projecting from the recesses 16. Electrical connection of each contact 18 with a corresponding conductor 32 is made by forcibly inserting a conductor lengthwise into the elongated narrow space defined between the pair of plates 44. The vertical edge margins 54 of each of the plates are deformed by coining to project diagonally inwardly of the space between the facing plates 44. The inwardly projecting edge margins 54 provide wire gripping jaws which are spaced apart a distance less than the diameter of a conductor 32. Two pairs of jaws are provided on each contact 18. Each pair of jaws are directly opposite one another and grip on directly opposite sides of a conductor inserted between the facing plates 44 as shown in FIG. 7. In addition the edge margins 54 have sharp vertical corner edges 58 which slice into an inserted cable to enhance electrical contact therewith. Two pairs of directly opposing jaws thereby grip the inserted cable conductor 32 at two locations along the length thereof.

Coining at 56 work hardens the metal and thereby strengthens the wire gripping jaws of the edge margins 54. The plates 44 are not required to engage an inserted wire 32 except where work hardened. The plates 44 are sufficiently thin to minimize the width of each contact 18 on either side of an inserted wire 32. Metal stock of such thickness would ordinarily be thought of as fragile and not capable of withstanding insertion of the wire 32 and not sufficiently strong to maintain effect contact pressure against the inserted wire. However, the small size of the contact actually contributes to its strength, because the plates are very close to the stiffened portions created by bending and forming both the bight 46 and the coined areas 56. The ordinarily weak and thin metal plates are thereby stiffened since they are so close to the bent and formed areas of metal. Also, in relation to the wire size to be inserted, the contacts are thick and thereby sturdy enough to resist wire insertion and to sustain resilient residual forces on either side of an inserted wire. The plates are in fact stiff enough that when the wire is inserted, deflection of the plates themselves is minimal. Instead the plates tend to be biased away from each other by pivoting, transferring the forces of deflection to the bight 46. The bight 46 undergoes most of the deflection, providing residual resilient forces on the plates tending to pivot them toward each other. The plates transfer such forces to the inserted wire to grip the same. Since two pairs of jaws are provided which are spaced apart a substantial distance by the lengthy faces of the plates, redundant electrical engagement of each contact with the wire and also permanent alignment of the wire between the relatively lengthy plates 44 and is maintained.

Figure 4:
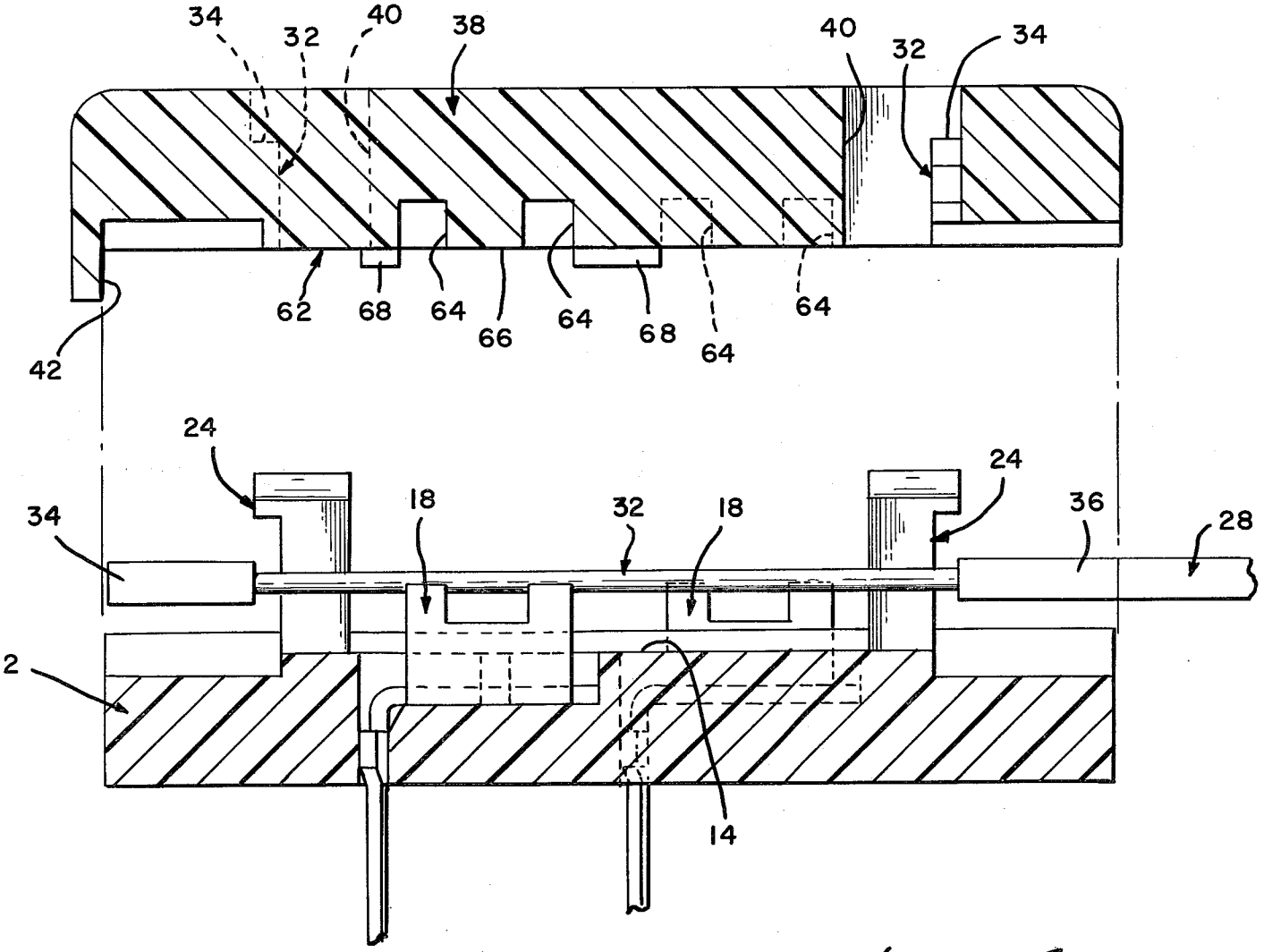
FIG. 4 is an enlarged fragmentary elevation in section of the component parts of the connector and flat cable illustrated in FIG. 1.
Figure 5:
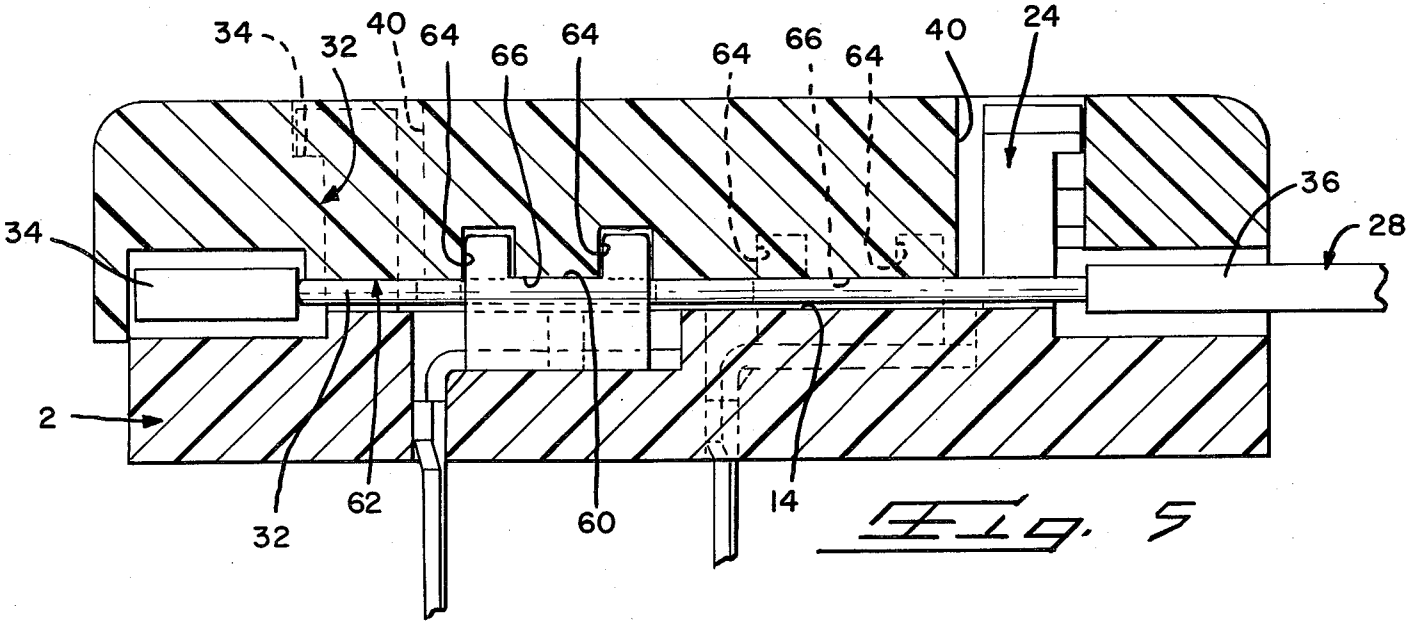
FIG. 5 is an enlarged fragmentary elevation in section illustrating the component parts of FIG. 4 in fully assembled condition.

Further details of a connector which incorporates a plurality of such contacts 18 as shown in FIGS. 4 and 5. The plates 44 are provided with corresponding vertically recessed notched portions 60 which are spaced from the coined areas 56 so as not to weaken the same. As shown in FIGS. 4 and 5, the cover portion 38 has an undersurface or inverted bottom surface 62 provided with a plurality of inverted recesses 64 vertically in alignment with the wire gripping jaws provided by the coined edge margins 54. When the cover portion 38 is assembled to the base portion 2 as shown in FIG. 5 each recess 64 will receive therein an opposed pairs of wire gripping jaws on the edge margins 54. A portion of the cover also enters the notch portions 60 of each of the contact plates 44. Therefore the cover completely encircles each pair of edge margins 54 within a separate recess 64. The cover portion which enters the notches 60 is shown at 66 having an undersurface flush with the cover surface 62. The cover portion 66 spans across each wire receiving passageway between the plates 44 of each contact and inserts a conductor into the wire receiving passageway. More specifically, the exposed conductors, when correctly interleaved between the alignment fingers 24, will be correctly positioned over wire receiving passageways 45 of the contact 18. This is shown more particularly in FIGS. 3 and 4. The cover is then assembled over the conductors 32 and the base 2. The under surface 62 of the cover as well as the under surface of the cover portion 66 impinge against the conductors 32 forcibly impelling them vertically downward as shown in FIGS. 4 and 5, forcibly inserting the conductors into wire receiving passageways 45 of the contacts 18 where they are electrically gripped by the wire jaws of the contacts. As shown in FIG. 5 the cover 38 is fully assembled to the base 2 when the alignment fingers 24 are latchably engaged with the cover projections 32 as previously described. As shown in FIG. 5 the under surfaces of the cover remain impinged against the conductors 32 preventing vertical movement of the same upwardly out of the wire gripping jaws of the contacts. The cover portions 66 which enter the notch portions 60 of the contacts are vertically stopped against the contact plates 44 precisely locating the inserted conductors 32 vertically with respect to the wire gripping jaws and preventing vertical over-travel of the wires and insuring that the wires are at the strongest gripping locations of the jaws.

To prevent horizontal misalignment of the wires as they are being inserted into the contact passageways 45, the cover is provided with a plurality of segmented vertically projecting flanges or alignment projections 68 which are aligned with the alignment fingers 24 when the cover portion 38 is assembled to the base 2. The alignment projections 68 straddle opposite sides of the conductors 32 and thereby cooperate with the alignment fingers 24 to support laterally and horizontally align the wires 32 both during and after insertion thereof into the contact passageways 45. The alignment projections 68 cooperate with the alignment fingers 24 to align and support substantial lengths of the conductors externally of the contacts closely adjacent thereto. The conductors 32 further are supported on the floor 14 of the base 2.

Figure 9:
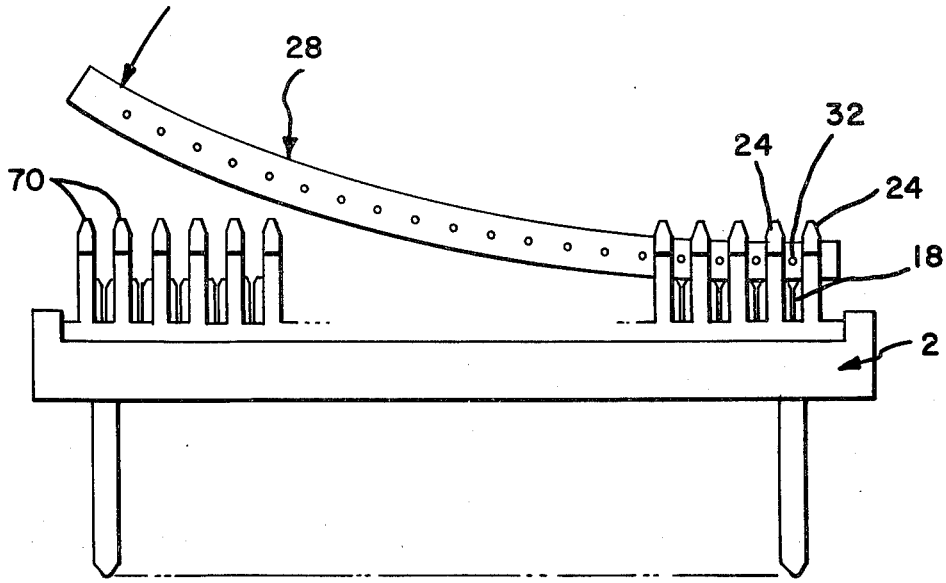
FIG. 9 is a schematic view of the base portion of a flat cable connector according to the present invention illustrating successive alignment and relocation, if necessary, of the cable conductors by unrolling the cable from a curved to a flat configuration.
Figure 10:
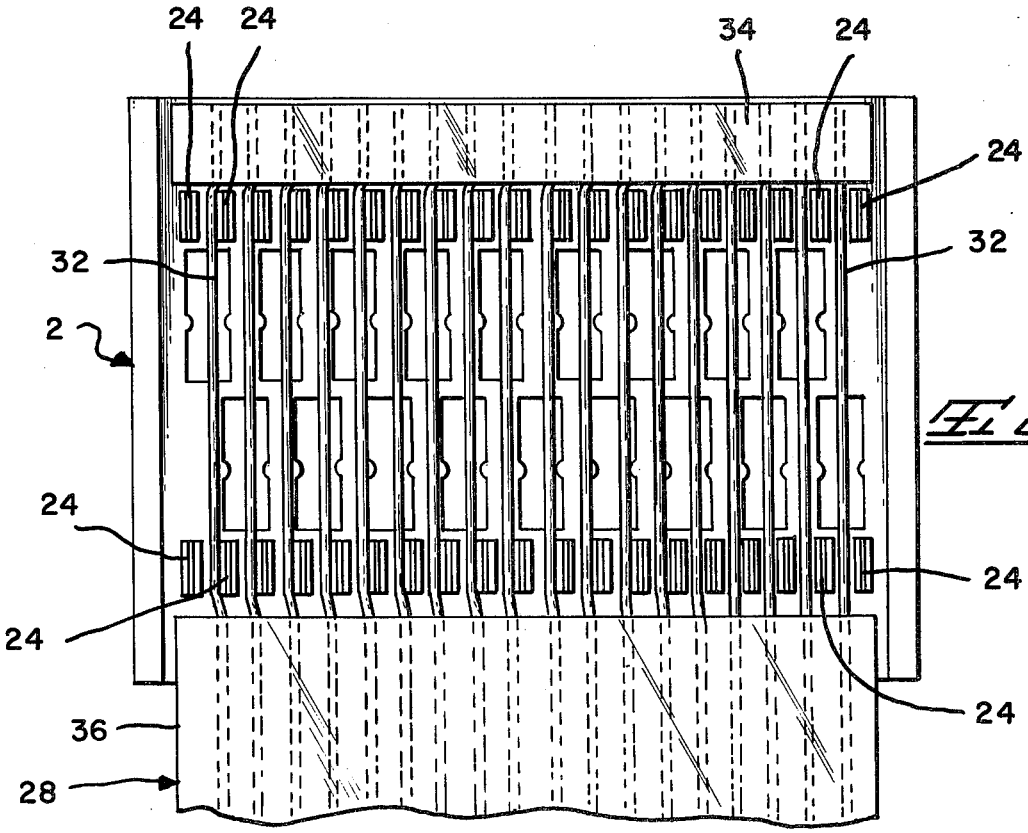
FIG. 10 is a top plan view of the base portion of the connector together with the cable wires interleaved with the alignment fingers and illustrating relocation of normally misaligned wires in proper registration with the connector contacts.

It has been found that due to manufacturing tolerances the conductors are often misaligned within the cable jacket 30. Accordingly it is difficult to align or interleave the conductors directly with the alignment fingers 24. A method according to the present invention is devised in which the conductors are successfully inserted between the alignment fingers 24. Such a method is described in conjunction with a schematic representation thereof in FIG. 9, wherein the cable 28 is shown bent into a curved configuration either by hand or over an appropriate curved mandrel, not shown. The conductors remain straight and are coplanar in a curved plane, since any axis of curvature is generally longitudinally of the conductors. A foremost one of the conductors 32 illustrated at the right hand side of FIG. 9 is inserted between the first pair of alignment fingers 24. Although only one row of alignment fingers 24 can be seen, it is understood that the foremost conductor is inserted between the first pair of fingers in each of the two rows of fingers provided on the base 2. With the foremost conductor 32 thus positioned it will be in alignment with a foremost contact 18. The cable 28 is then progressively unrolled from its curved configuration to its flat configuration shown, for example, in FIG. 3. More specifically the cable as illustrated in FIG. 9 is progressively unrolled from the right hand side to the left hand side of the Figure. As the cable is progressively unrolled, and thereby straightened or flattened, the conductors 32 are successively inserted into the channels between corresponding alignment fingers 24, thereby successively aligning the conductors vertically over the contacts 18. It has been found that such method of assembly individually relocates each individual conductor 32, if its alignment in the cable is unpredictable and incorrect because of manufacturing tolerances. FIG. 10 illustrates a cable 28 which has the conductors 32 thereof successively interleaved with the rows of alignment fingers 24 according to the method described in conjunction with FIG. 9. The foremost conductor 32 at the right hand side of FIG. 10 is inserted without a need for bending or relocating the same, and is illustrated therefore as being substantially straight as it bridges between the separated jacket sections 34 and 36. However, the remaining conductors of the cable 28 which appear to the left hand side of FIG. 10 are bent and thereby relocated in order for them to be correctly interleaved and vertically inserted between the two rows of alignment fingers 24. Therefore, relocation of the conductors 32 for correct alignment with the contacts 18 is accomplished despite misalignment of the conductors within the cable jacket 28. However, since it is impractical to grasp each conductor individually and insert it in correct alignment with the contacts 18, by unrolling the cable from a curve to a flat configuration the conductors effectively are inserted individually while the cable is treated as an entirety rather than as individual conductors. As shown in the drawings the top ends of the alignment fingers 24 are substantially tapered to thin edges extending longitudinally of the cable conductors 32. This reduces the possibility of the conductors snagging against the tops of the alignment fingers. Also the tapered shape provides a flared entryway for the spaces or channels between the alignment fingers, and thereby a larger target for the conductors 32 as they are displaced about an arcuate path of motion when the cable is progressively flattened. Accordingly the conductors readily enter the spaces between the alignment fingers and are relocated by bending the same only after passing vertically downward in the narrowing spaces or channels between the fingers.

Although a preferred embodiment of the present invention is described and shown in detail other embodiments and modifications thereof which would be apparent to one having ordinary skill in the art intended to be covered by the spirit and scope of the appended claims.

I claim:

1. In an electrical connector having first and second cooperating housing portions containing electrical contacts for connection to spaced conductors of a multi-conductor cable, the improvement comprising;

first and second rows of parallel and elongated vane members projecting from a first housing portion and defining first and second rows of conductor receiving channels, said vane members having relatively thin elongated top edges merging with thickened base portions which substantially reduce the widths of said conductor receiving channels approximately to the widths of said conductors, electrical contacts between said first and second rows of vane members and having conductor contacting portions in alignment with said reduced width conductor receiving channels, each of said contacts having electrical lead portions externally projecting from said first housing, and means on said thickened base portions for latchable engagement with said second housing portion, each said contact includes first and second wire gripping jaws for gripping opposite sides of a corresponding conductor in two locations along the length thereof, each said contacts includes first and second plates connected by a web, the outside corner edges of said plates being coined, and the inside corner edges projecting diagonally inward toward each other and defining said first and second pairs of wire gripping jaws for slicing engagement on opposite sides of a conductor inserted between said plates and between pairs of said inside corner edges.

2. The structure as recited in claim 1, wherein, each said pairs of plates includes vertically recessed notches, and said second housing section includes projecting portions bridging across said pairs of plates and received in said notches, said projecting portions and said webs being in spaced relationship to define conductor receiving spaces therebetween.

3. An electrical connector for terminating parallel coplanar conductors of a multi-conductor cable, comprising:

a first housing portion, first and second spaced rows of vertically projecting latching fingers, electrical contacts disposed between said rows of fingers and having wire receiving jaws aligned with spaces between said fingers of each respective row, said latching fingers having relatively thin top edges elongated in the same direction as the conductors of said cable and being substantially narrower than the spaces between said conductors, said edges being continuous with thickened bottom sections of said latching fingers defining relatively narrow elongate conductor receiving channels for receiving and aligning sections of the conductors over said wire receiving jaws, a second housing portion latchably engageable with said fingers and cooperating with said first housing portion for enclosing said jaws and pressing said aligned sections of said conductors forcibly between said jaws, whereby said jaws grip said sections of said conductors establishing electrical connections therewith, each said contacts includes first and second plates connected by a web, the outside corner edges of said plates being coined, the inside corner edges projecting diagonally inward toward each other defining said conductor receiving jaws, said inside corner edges being in sliced engagement on opposite sides on a conductor inserted between said plates and between pairs of said inside corner edges.

4. The structure as recited in claim 3, wherein, each said pairs of plates includes vertically recessed notches, and said second housing includes projecting portions emerging across said pairs of plates and received in said notches, said projecting portions and said webs being in spaced relationship to define conductor receiving spaces therebetween.

5. An electrical connector including:

a first housing portion having a mating side provided with a plurality of elongate wire receiving channels communicating with contact receiving cavities, said cavities including openings communicating with an external surface of said first housing portion, one piece electrical contact in each said cavities, each contact including a pair of vertical side plates connected by an integral web and an electrical lead portion integral with an end of said web and bent to project vertically outward of one of said openings, said pairs of side plates being parallel with said channels and defining therebetween wire receiving passageways overlying corresponding webs, the vertical edges of said plates being coined and work hardened thereby, said inside vertical corner edges of said plates being deflected upon coining diagonally inward toward said passageways, said inside corner edges forming spaced pairs of vertical slicing edges spaced apart a distance less than the thickness of a corresponding conductor and projecting into said passageways for gripped electrical connection on opposite sides of a corresponding conductor and at two locations thereof, central portions of said plates being vertically notched, and a second housing portion having a mating side cooperating with the said first housing portion enclosing said wire receiving channels and said wire receiving passageways of said electrical contacts, said second housing portion mating side entering the notched portions of said plates thereby confining said conductors between said plates, and said second housing portion defining conductor receiving spaces adjacent said webs of said contacts.

6. A method for connecting multiple conductor cable with an electrical connector, comprising the steps of:

exposing lengths of individual conductors intermediate separated portions of insulating jacket sections, arcuately bowing said cable about an axis extending lengthwise of said conductors, aligning a first conductor along a first side of said cable between alignment partitions of a connector, progressively flattening said cable in a direction laterally across said conductors whereby as said cable flattens said conductors become sequentially inserted in between corresponding partitions of said connector, forcefully inserting said conductors between wire gripping jaws of electrical contacts aligned with spaces defined between said partitions, thereby electrically connecting said conductors within the wire gripping jaws of said contacts, and matingly engaging first and second insulation housing sections enclosing therebetween said electrically connected sections of said conductors.

* * * * *